United States Patent [19]

Cantile

[11] Patent Number: 4,739,606

[45] **Date of Patent: * Apr. 26, 1988**

[54] CONVEYOR MEANS OF SYSTEM FOR IN-LINE PROCESSING OF ENVELOPES AND THE LIKE

[75] Inventor: Jack W. Cantile, Richmond, Va.

[73] Assignee: Hammermill Paper Company, Erie, Pa.

[ * ] Notice: The portion of the term of this patent subsequent to Dec. 9, 2003 has been disclaimed.

[21] Appl. No.: 924,742

[22] Filed: Oct. 30, 1986

Related U.S. Application Data

[63] Continuation-in-part of Ser. No. 387,106, Jun. 10, 1982, Pat. No. 4,627,222.

[51] Int. Cl.[4] ..... B65B 57/00

[52] U.S. Cl. ..... 53/493; 53/154; 53/240; 53/131; 53/569

[58] Field of Search ..... 53/154, 443, 240, 540, 53/266 R, 131, 266 A, 569, 381 R, 382, 386; 270/1.1, 9, 12, 18, 58; 271/9

[56] References Cited

U.S. PATENT DOCUMENTS

| | | | |
|---|---|---|---|
| 1,779,310 | 10/1930 | Fischer . . | |
| 1,848,856 | 3/1932 | Wagner et al. . | |
| 1,903,361 | 4/1933 | Post . | |
| 1,948,142 | 2/1934 | Swift, Jr. . | |
| 2,033,849 | 3/1936 | Mudd . | |
| 2,082,064 | 6/1937 | Kleineberg . | |
| 2,083,296 | 6/1937 | Davidson . | |
| 2,233,153 | 2/1941 | Welk . | |
| 2,248,079 | 7/1941 | Harrold et al. . | |
| 2,251,945 | 8/1941 | Labombarde . | |
| 2,374,668 | 5/1945 | Davidson . | |
| 2,425,936 | 8/1947 | Hepp . | |
| 2,432,133 | 12/1947 | Babicz . | |
| 2,704,209 | 3/1955 | Halahan et al. . | |
| 2,770,458 | 11/1956 | Halahan et al. . | |
| 2,834,596 | 5/1958 | Halahan et al. . | |
| 2,849,099 | 8/1958 | Halahan et al. . | |
| 2,849,232 | 8/1958 | Halahan et al. . | |
| 2,859,964 | 11/1958 | Aronson et al. . | |
| 2,861,803 | 11/1958 | Halahan et al. . | |
| 2,918,278 | 12/1959 | Aronson et al. . | |
| 3,048,099 | 8/1962 | Davidson et al. | 270/58 X |
| 3,087,723 | 4/1963 | Lyon . | |
| 3,131,930 | 5/1964 | Lyon et al. . | |

(List continued on next page.)

FOREIGN PATENT DOCUMENTS

| | | |
|---|---|---|
| 542869 | 7/1957 | Canada . |
| 1076413 | 4/1980 | Canada . |
| 616619 | 4/1980 | Switzerland . |
| 620139 | 11/1980 | Switzerland . |
| 765980 | 1/1957 | United Kingdom . |
| 1524178 | 9/1978 | United Kingdom . |

*Primary Examiner*—Robert L. Spruill
*Assistant Examiner*—Steven P. Weihrouch
*Attorney, Agent, or Firm*—Fitch, Even, Tabin & Flannery

[57] ABSTRACT

A system for in-line processing of envelopes and the like includes a first upstanding feed hopper for feeding primary envelopes through a first printing station operative to print predetermined indicia on the primary envelopes after which they are conveyed in the direction of their major longitudinal axes through a plurality of inserter stations operative to insert special event envelopes between selected ones of the primary envelopes. The primary and insert envelopes are conveyed by conveyance means in-line past an ink jet type printer station operative to print particular cluster data on each successive envelope making up a set, followed by a station for the automatic collating and packaging of sets of envelopes into cartons. The conveyance means include a endless vacuum belt which holds the envelopes flat in a continuous stream and allows easy transfer to and from the conveyance means. The vacuum belt conveyance means increases the speed at which the system can be run because the envelopes are positively held in a predetermined location during their transport. Pulse encoders and photoelectric sensors cooperate with various elements of the system and a data processor to effect automatic high speed operation of the system.

30 Claims, 8 Drawing Sheets

U.S. PATENT DOCUMENTS

| | | | |
|---|---|---|---|
| 3,222,056 | 12/1965 | Lyon et al. . | |
| 3,423,084 | 1/1969 | Konazewski . | |
| 3,589,100 | 6/1971 | Konars et al. . | |
| 3,796,426 | 3/1974 | Schilpf . | |
| 3,979,884 | 9/1976 | Russell | 53/386 X |
| 4,017,004 | 4/1977 | Onoe et al. | 271/9 X |
| 4,038,921 | 8/1977 | Harrison et al. . | |
| 4,077,181 | 3/1978 | Asher et al. | 53/154 X |
| 4,082,262 | 4/1978 | Konars et al. . | |
| 4,118,025 | 10/1978 | Konars et al. . | |
| 4,299,325 | 11/1981 | Quinton et al. . | |
| 4,373,848 | 2/1983 | Bishop | 53/381 R X |
| 4,375,190 | 3/1983 | Quinci et al. . | |
| 4,588,179 | 5/1986 | Gutierrez | 270/58 |

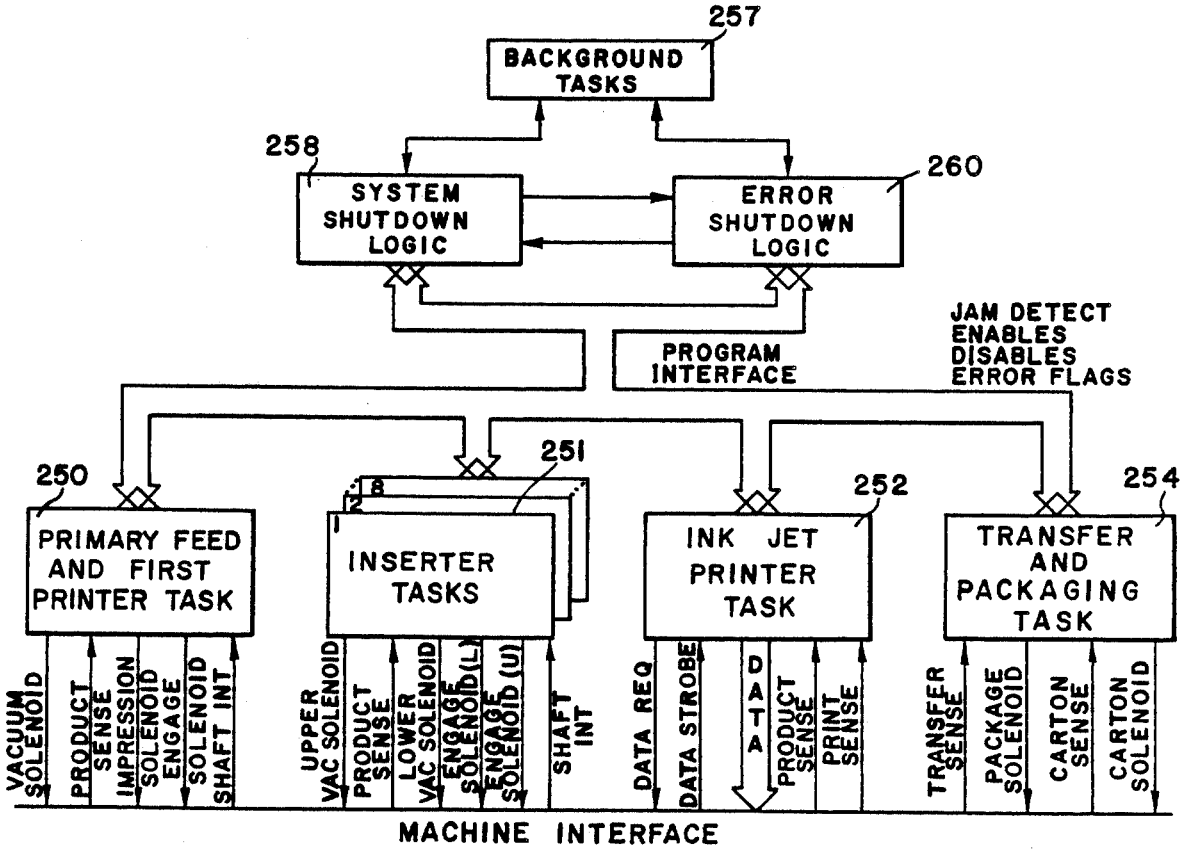
FIG. 13A
FIG. 13B
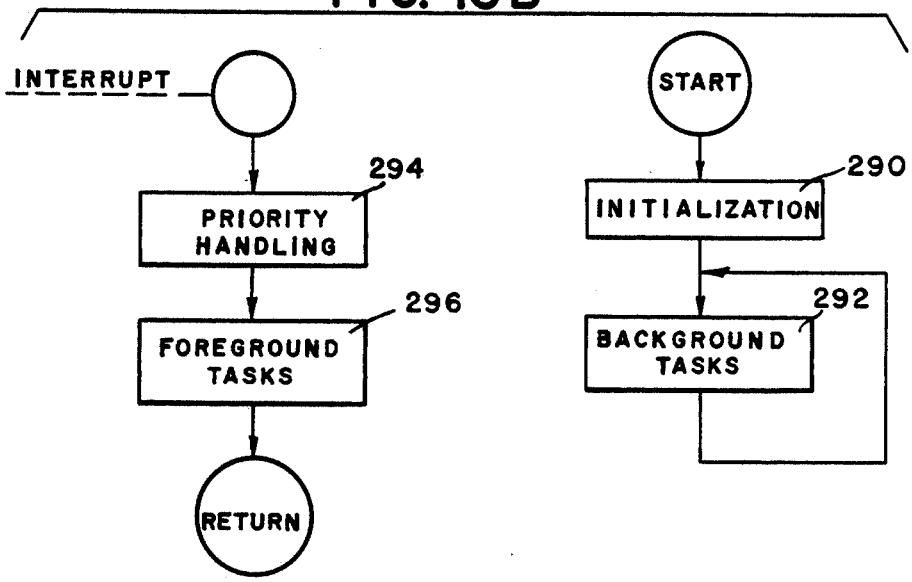

CONVEYOR MEANS OF SYSTEM FOR IN-LINE PROCESSING OF ENVELOPES AND THE LIKE

CROSS REFERENCE TO RELATED APPLICATIONS

This application is a continuation-in-part of application Ser. No. 387,106 filed on June 10, 1982 in the name of Jack W. Cantile and entitled "SYSTEM FOR IN-LINE PROCESSING OF ENVELOPES AND THE LIKE", now U.S. Pat. No. 4,627,222 which application is assigned commonly with the present application. The disclosure of Cantile, Ser. No. 387,106, is expressly incorporated herein by reference.

BACKGROUND OF THE INVENTION

The present invention pertains generally to systems for processing envelopes and the like, and is more particularly directed to a conveyance means of a system for the automatic in-line printing, numbering, dating, collating and packaging of a substantially continuous flow of envelopes in the form of primary envelopes between which insert envelopes may be selectively disposed as the primary envelopes are conveyed along a predetermined path.

It is a conventional practice in many organizations, particularly church congregations, to provide envelopes to members in which regular donations or offerings may be made for financial support. In the case of church offerings, the envelopes used for offerings are generally of a smaller size than conventional letter size envelopes, approximately 3.25×6.25 inches and of rectangular shape. The front face of each envelope is commonly imprinted with the name of the church and frequently the particular purpose of the envelope, such as "Weekly Offering". A set of such envelopes is generally contained within a carton, with each envelope being serially numbered and dated to indicate the date on which the envelope is to be used. Frequently, one or more insert or special envelopes are intermixed in a selected date order with the main offertory envelopes so as to remind the church member of a particular church activity or special offering during the church year. The insert envelopes are included in the serial numbering sequence and may additionally include different indicia.

Traditionally, envelopes, such as offertory envelopes, which are to be packaged as primary envelopes in predetermined order in small individualized cartons have been prepared by printing the desired indicia on each envelope at a first operating station. Thereafter, a quantity of the printed primary envelopes are manually transported to a separate inserter station for either manual or mechanical insertion of special insert envelopes at selected positions between the primary envelopes. In accordance with known prior practices, the primary envelopes are printed with particular customer indicia, such as the name and/or logo of the organization, by means of a print cylinder as they are fed from a hopper onto a conveyance means for transfer to the inserter station. Prior to reaching the inserter station, the primary envelopes are further printed with the date on which the envelope is to be used, and a serial number common to each envelope in a given set. This requires that the insert envelopes be preprinted to indicate not only the particular event for which they are to be used, such as a Thanksgiving offering, but also the date of the corresponding event and a serial number matching the serial number printed on the primary envelopes making up the set into which the insert envelopes will be inserted. Thereafter, the envelopes are collated into sets and packaged into individualized cartons.

A significant drawback in the previous manner in which primary and insert envelopes, and the like, have heretofore been printed and collated is that should a particular job or "run" of envelopes be changed, such as by reducing the number of primary and insert envelopes which are to make up a given set, substantial waste is incurred due to the preprinted but unused insert envelopes. A further drawback is that the prior techniques have required relatively high labor intensity for the preprinting and insertion process which contributes significant expense to the effort of soliciting contributions from church members. Since the use of such offertory envelopes is widespread and entails substantial numbers of envelopes, it will be appreciated that significant cost reductions can be realized if the manufacturing process for them, i.e., printing primary envelopes, selectively inserting special insert envelopes between the primary envelopes, sequentially numbering and dating both, and collating and packaging the envelopes into individualized cartons, can be improved so as to reduce both the waste and the labor cost factor of prior methods.

A particularly advantageous apparatus is described in the referenced Cantile application to overcome these problems and provides an automatic high speed system for printing, numbering, dating, collating, and packaging a substantially continuous flow of envelopes in the form of primary envelopes between which insert envelopes can be selectively disposed as the primary envelopes are conveyed along a predetermined path. Generally, the conveyance means for moving the continuous stream of envelopes along the predetermined path is a chain driven pusher type linkage having spaces for each envelope between each set of upstanding pushers. An envelope, either a primary or insert, is delivered in between a set of the pushers and is propelled or pushed along in the continuous stream by motion of the linkage. While considerably more advanced than the prior systems, several reasons make the apparatus with the described conveyance means less advantageous than need be.

First, when the chain linkage is operated at high speeds, for example 25,000 to 40,000 envelopes/hr., the envelopes have a tendency to fly up and float off the linkage because of the lift caused by the air rushing over them at high speeds. This effect is particularly detrimental when it occurs near a printing station. In the aforementioned Cantile application, an ink jet print station is triggered by an edge detecting photocell and used to print at high speeds many of the serialized indicia used on the envelopes. If the envelopes are not substantially flat while being sprayed or ink jetted at the printing station, then misprints, hard to read indicia, poor quality printing, and the like are the result. The lifting effect increases with chain speed and tends to limit production rates if not overcome. It would be highly advantageous to operate the envelope processing apparatus described in Cantile without such effect.

Further, at head end of the conveyance means of the aforementioned system, a primary printing station prints indicia on the primary envelopes and then transfers them to the conveyance means for the inserting process and a second printing process. At high speeds with a continuous flow it is a delicate process to place or transfer an envelope correctly onto the linkage or pusher chain between a set of pushers. The envelope not only has to be placed with the correct timing spatially, but also in such a manner that it lays relatively flat so that it does not jam the conveyance means and the subsequent printing station is not presented with a registration problem. There also exists the opposite problem at the distal end of the conveyance means prior to a boxing and cartoning station, i.e., that of removing the high speed continuous flow of envelopes from between the pushers of the chain linkage.

The pusher type conveyance means is additionally somewhat inflexible because once the size of the envelope is selected, the distance between the the pushers is set. If it is desired to change the apparatus for processing a different size of envelope, then the entire conveyance chain must be changed to a different size and retimed. It is more desirable to have such a high speed piece of capital equipment flexible enough to be used for several different types of tasks and capable of handling similar stock in the same category.

Because the prior conveyance means is timed relatively closely in terms of the physical spacing of the envelopes, the machine is preferably run at a certain set speed and controlled off of one reference interrupt from a single shaft encoder for the feeder of the primary envelopes. With increasing speed or the number of inserts, such timing is problematic as errors in position or timing of the stream of envelopes tend to accumulate in an unpredictable manner. Further, the mechanical linkage can wear, introducing further imprecision into the timing. Such mechanical considerations have a tendency to limit the speeds at which such envelope processing apparatus can be run.

SUMMARY OF THE INVENTION

The invention provides a high speed vacuum conveyance means for a system utilized in processing envelopes and the like. A particular envelope processing system for the automatic in-line printing, numbering, dating, collating, and packaging of a substantially continuous flow of envelopes in the form of primary envelopes between which insert envelopes are selectively disposed as the primary envelopes are conveyed along a predetermined path is used to illustrate the conveyance means to advantage. Additionally, a control system using a cyclic mechanical operation based on envelope flow and independently timed from a series of interrupts is provided for the envelope processing system in conjunction with the high speed conveyance means.

Preferably, the conveyance means is disposed between a primary envelope print station and a transfer and boxing station of the system. The primary envelope print station transfers primary envelopes to the conveyance means in a continuous flow in which spaces are left for the insert envelopes. The insert envelopes are inserted into the spaces and the continuous stream conveyed to the transfer and boxing station after a second printing. The conveyance means includes a flexible web with vacuum apertures provided therethrough which can be transported at high speeds in a vacuum channel between two rails of a vacuum plate. Vacuum is supplied to the apertures so that envelopes placed on the web retain their position with respect to other envelopes while the web is transported. The vacuum feature further holds each envelope onto the web during transport to produce a flat print surface which considerably reduces the amount of misregistration and misprinting problems even at high speeds.

The conveyance means because of the vacuum on the web provides a facile transfer of envelopes from the primary print station and the inserter stations to the web and a facile transfer from the web to the transfer and boxing station. The vacuum on the web does not affect the envelope until a certain portion of the envelope has been placed on the web. That portion and the forward movement of the web thereafter act to pull the rest of the envelope onto the web where it is held firmly. This operation provides a positive transfer of the envelope from the primary print station or an inserter station onto the web and a means to quickly flatten the envelope against the web during rapid transportation. In addition, the vacuum can be cut off to the web at any point in the transportation, for example, the distal end of the web to allow the facile transfer of an envelope to the transfer and boxing station.

Holding each envelope by a vacuum on the web as it is transported provides a significant improvement to the system for processing envelopes discussed previously. With the substitution of a vacuum conveyance means for the pusher chain conveyance means hereinbefore described, the insert timing problem is reduced as the control system does not have to critically position an insert envelope in a predetermined physical slot of the continuous flow of envelopes. The control system only has to insert an envelope between the space left after one envelope and before the beginning of the next one, and such space can be larger than one envelope length or the distance between two sets of pushers on a chain. This creates a very flexible machine whereby the machine does not need to be retimed and the conveyor chain replaced if a longer or shorter stock envelope is used. Further, the apparatus can be run efficiently at a number of different speeds to match a desired production rate, and at much higher speeds than previous envelope processing systems.

Along with the vacuum conveyance means, the system implements a new control system for the envelope process handling which is interrupt driven and has every task independently operated. In general, a primary print station and feeder are synchronized with the conveyance means and each of a plurality of inserter stations downstream by timing chains. The primary feeder and the inserters run a similar continuous cycle which is timed from an interrupt generated by a shaft encoder attached to rotating part of each device. The interrupt indicates that the mechanics of the feeder or inserter is ready to place an envelope in the next space of the continuous stream at the speed the conveyance means is operating. The control senses each interrupt and handles it accordingly by calling a subroutine corresponding to the task of the apparatus signaling. The called subroutine is executed to determine if there is anything to be done by the calling apparatus during that cycle by checking a table which is continually updated to control the overall process. With this method, each independently timed feeder and inserter mechanism has a better probability of correctly timing the feed or insertion of an envelope in the continuous stream as it is correctly timed to the other mechanical parts of the system and electronically timed for its own task.

A system program reads in operator data to set the program tables indicating when a particular inserter device should feed. An interrupt from a device then causes an interrupt handler program to call a control routine associated with the particular device. The system control routine during its execution checks the program table to determine if this is the correct cycle to insert or feed. Upon finding an indication to feed, the called program will cause the feed of a primary or an insert envelope from a stack and consequent placement on the conveyance means.

Further objects and advantages of the present invention, together with the organization and manner of operation thereof, will become apparent from the following detailed description of the invention when taken in conjunction with the accompanying drawings wherein like reference numerals designate like elements throughout the several views.

BRIEF DESCRIPTION OF THE DRAWINGS

FIGS. 13A and 13B are a task control logic diagrams for the control logic block diagrams illustrated in FIGS. 14A–D.

DETAILED DESCRIPTION OF PREFERRED EMBODIMENT

Figure 1:
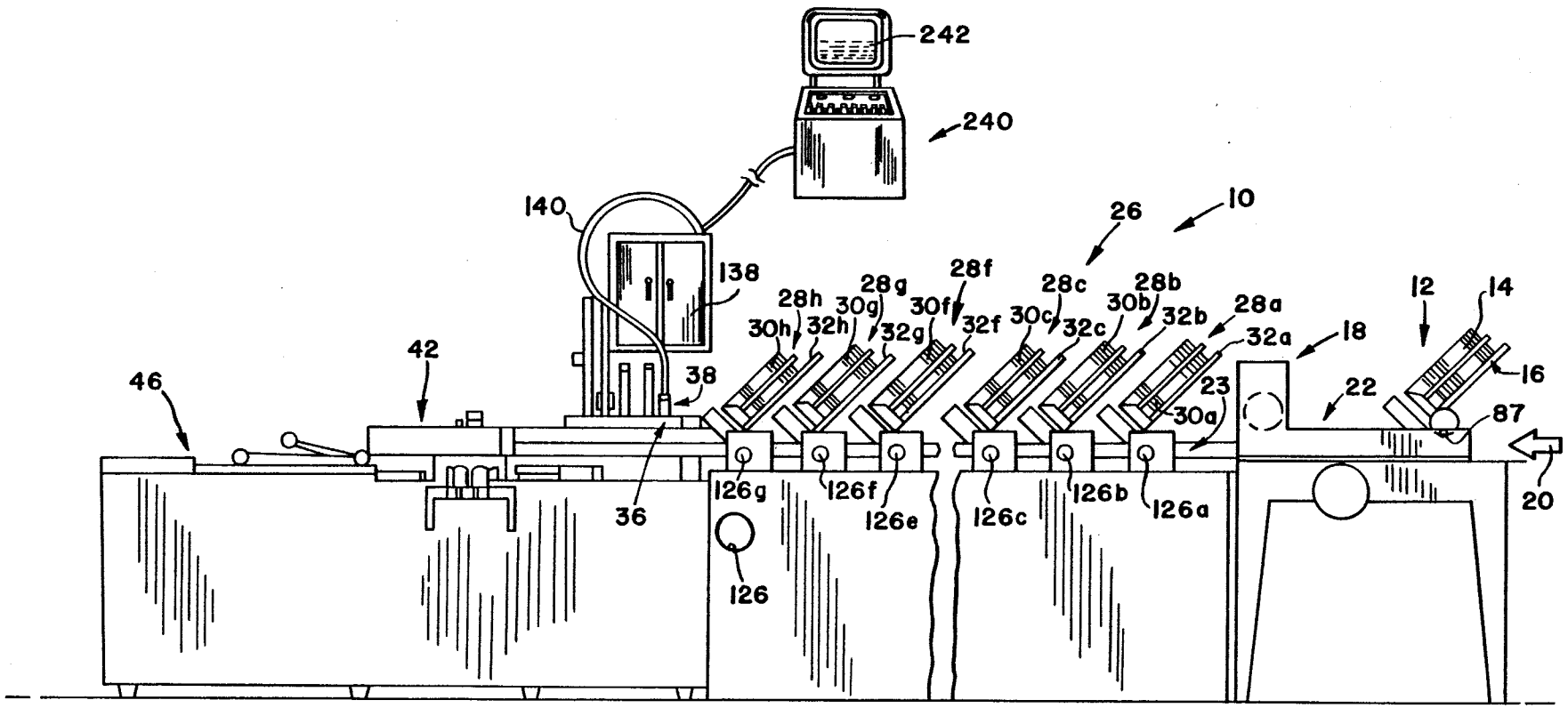
FIG. 1 is a schematic elevational view of a system for the in-line processing of envelopes including a vacuum conveyance means and control system constructed in accordance with the present invention.

Referring now to the drawings, and in particular to FIG. 1, a system for the in-line processing of rectangular and flat envelopes, and the like, is indicated generally at 10. In operation, the envelope processing system 10 is operative to automatically perform a predetermined sequence of in-line operations on the rectangular envelopes which, in the illustrated embodiment, comprise primary envelopes and insert or special envelopes. The primary and insert envelopes are automatically printed and collated in a predetermined order and then packaged in cartons so that each carton contains a predetermined number or set of envelopes comprising the primary envelopes selectively intermixed with the insert envelopes. In general, the basic system operation is more fully described in the referenced Cantile application.

As will become more apparent hereinbelow, the envelope processing system 10 finds particular application in the processing of envelopes which have conventionally been employed as offertory envelopes by church members for use in weekly and special occasion financial offerings. While the system 10 is described herein in conjunction with the in-line processing of such rectangular envelopes, it will be appreciated that the system may find other applications wherein it is desired to automatically process in-line generally rectangular flat sheets of paper material or the like which are to be selectively printed and which are to have insert sheets selectively interpositioned therewith followed by automatic collating and packaging into predetermined sets or batches.

The system 10 is operative to automatically effect in-line feeding and printing of the primary envelopes, to insert the special insert envelopes into a continuously conveyed stream of primary envelopes, to print individualized indicia on each of the continuous stream of successive envelopes, and to collate and package the envelopes into sets in cartons. To this end, the system 10 includes first hopper and feeder means, indicated generally at 12, for supporting a plurality of substantially flat primary envelopes 14 in an upstanding hopper 16 and sequentially feeding the primary envelopes to a first printing means, indicated generally at 18. The feeding of the primary envelopes 14 is in response to command signals to be hereinafter described.

In the illustrated embodiment, the envelopes making up the stack of primary envelopes 14 are of a rectangular configuration, such as approximately $3.25 \times 6.25$ inches in size. The envelopes 14 are supported in generally upstanding relation by the hopper 16 such that when they are fed to printing means 18, the major longitudinal axis of each envelope is disposed substantially parallel to the direction in which they are conveyed in-line through the system 10, as represented by an arrow 20 in FIG. 1.

The first printing means 18 is operative to print a predetermined indicia on the upwardly facing surface of each successive primary envelope 14 fed from hopper 16 to the printing means on a conveyor means, indicated generally at 22. Such predetermined indicia may, for example, comprise the name and/or address of a particular church along with any associated art work as may be desired, such as a logo or an artist's rendering of the church. The printing means 18, which may be termed the first work or operating station, comprises a cylinder and plate type printer which is operative in response to first print command signals to print the predetermined indicia on the primary envelopes 14 as they pass through the printer in the direction of their major longitudinal axis.

After transfer from the first printing means 18, the primary envelopes are sequentially conveyed by a conveyance means, indicated generally at 23, along a predetermined in-line path to a plurality of second work or operating stations, termed inserter stations, and indicated generally at 26. One of the aspects of the invention, the conveyance means 23 is a high speed vacuum conveyor and will be more fully described in detail hereinafter. The transfer from the first printing means 18 to the vacuum conveyance means 23 occurs by pushing the envelopes onto the conveyance means with a commonly used mechanical transfer mechanism.

In the illustrated embodiment, the inserter stations 26 number eight inserters, indicated specifically as 28*a*, 28*b*, 28*c*, . . . , 28*f*, 28*g*, 28*h* but could be more or less depending on the specific job required. Each inserter station is adapted to support a plurality of special or insert envelopes indicated at 30*a*, 30*b*, 30*c*, . . . , 30*f*, 30*g*, 30*h*, respectively, in a corresponding generally upstanding hoppers 32*a*, 32*b*, 32*c*, . . . , 32*f*, 32*g*, 32*h*. The insert envelopes 30 are generally of the same rectangular shape and size as the primary envelopes 14 and are manually placed in the upstanding hoppers 32 with their major longitudinal axes disposed parallel to the direction of the path along which the envelopes are conveyed by the conveyance means 23.

As will be described, the first hopper and feed means 12 is operative in response to predetermined command signals to establish spaces between selected ones of the primary envelopes 14 discharged from the hopper 16 so that the spaced primary envelopes remain in their spaced relation as they move through the printer means 18 on the conveyor means 22. As used herein, the term "space" or "spaces" refers to blank locations on conveyor means 22 being created between selected ones of primary envelopes fed from the first hopper and feed means 12 in response to command signals. A space is of sufficient size (length) to receive an insert envelope therein when disposed with its longitudinal axis parallel to the longitudinal axis of a primary envelope.

Each of the inserter stations 26 is operative upon receipt of a predetermined command signal to deposit a corresponding insert envelope 30 into a selected space created between the primary envelopes 14 for this purpose as the primary envelopes are conveyed in-line on the vacuum conveyance means 23. The insert envelopes 30 in each of the stacks may be preprinted with indicia indicating a specific purpose. For example, the insert envelopes 30*a* might request funds to defray the cost of a year's supply of offertory envelopes, while insert envelopes 30*b*, 30*c*, . . . , 30*f*, 30*g*, 30*h* might be designated for special offerings such as Easter, Thanksgiving and Christmas, etc. Insertion of insert envelopes 30 from the inserter stations 26 onto conveyance means 23 is controlled by predetermined command signals so that only one insert envelope will be discharged from any one of the inserter stations 26 into a space arriving at the selected inserter for this purpose from the printing means 18.

The conveyance means 23 is operative to rapidly advance the primary envelopes 14 thereon and any insert envelopes 30 which have been selectively positioned between the primary envelopes to a third work or operating station 36 at which is located a second printing means indicated generally at 38. The second printing means 38, in combination with a print console 138, is operative to print individualized indicia, such as a date and an individual customer identification or serial number, on each individual envelope passed through the operating station 36. For example, where the envelopes are to be used as offertory envelopes, the envelopes may be serially numbered and dated by the second printing means 38 in response to predetermined command signals, as will become more apparent hereinbelow.

From the second printing station 36, the primary and insert envelopes are conveyed by conveyance means 23 to a fourth work or operating station, indicated generally at 42, which comprises a transfer station. The transfer station 42 is operative to receive the envelopes from the conveyance means 23 to produce a stack. When the transfer station 42 has received the predetermined number of envelopes which constitutes a set or batch, it causes the transfer of the set of envelopes to a packaging or boxing station, indicated generally at 46. The packaging or boxing station 46 is operative to automatically insert each set of envelopes into an individual tuck style carton which has been automatically erected in the packaging station. After the carton is closed, it is conveyed to a discharge position on the packaging station for packing into a shipping container. The mechanics of the transfer station 42 and packaging station 46 have been omitted herein for the purpose of clarity, but are more fully described in the referenced Cantile application.

The commands for timing the feeding of the primary envelopes, the printing of the primary envelopes, the insertion of the insert envelopes, the sequential printing of the primary and insert envelope collation, and the transfer and packaging of each set is generated by a system control, comprising a data processor indicated generally at 240 with an associated visual monitor 242. Basically, an operator inputs the parameters of a run or job, such as the number of envelopes in a set, the speed of operation, the placement of the insert envelopes, the indicia to be printed by the second printing means, the number of sets, and starts the apparatus 10. The apparatus will then run automatically to produce the collated and printed sets until the end of a run, or until stopped by the operator or a fault detection.

Figure 2:
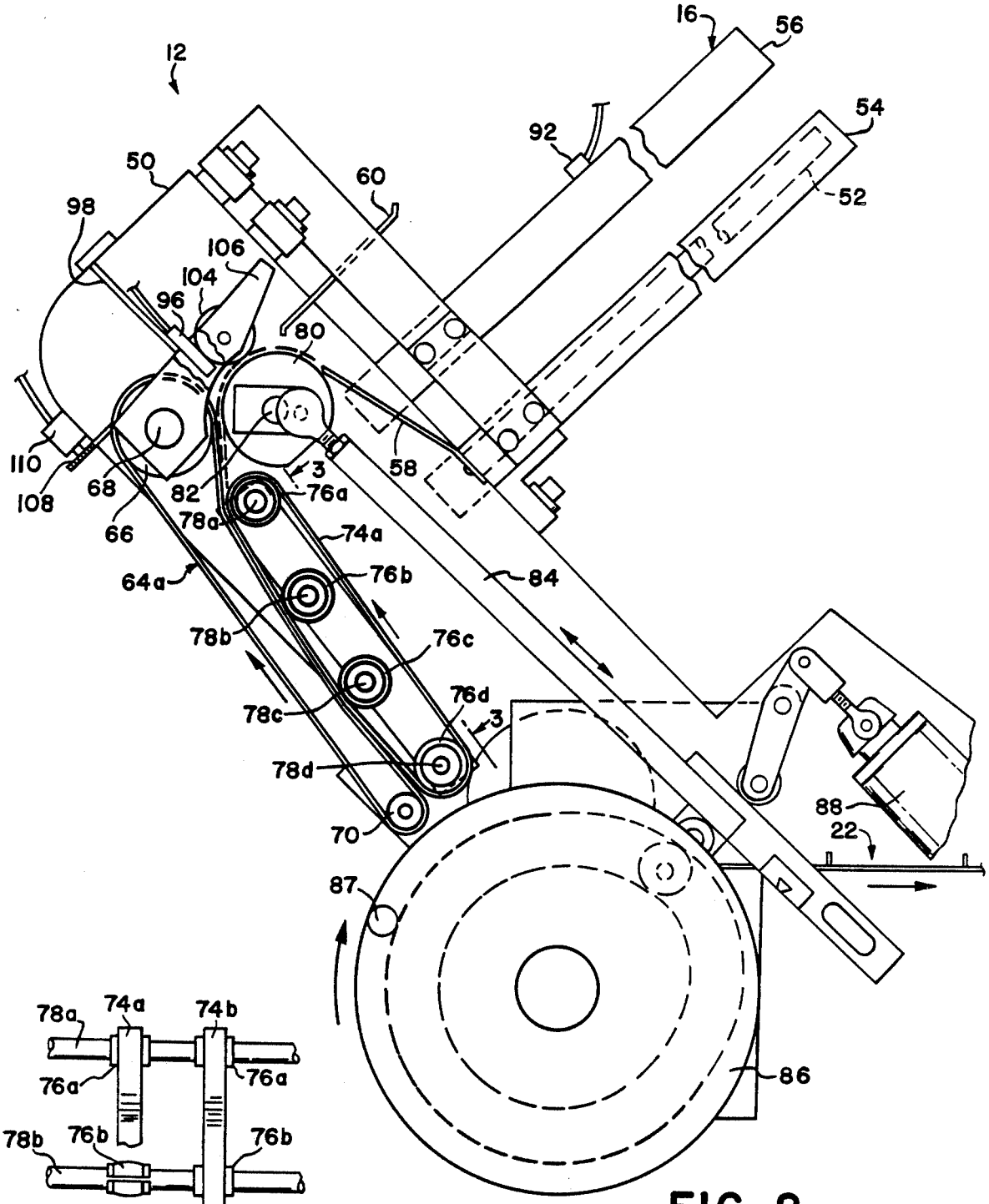
FIG. 2 is a schematic side view of the primary envelope feeder with one of its side plates removed.

Turning now to a more detailed description of the elements of the envelope processing system 10, the first hopper and feed means 12 and printing means 18 may substantially comprise a known feeder and printing press such as is commercially available from Halm Industries Co., Inc., as its Model No. JP-6 printing press, with some modifications as hereinafter described. Referring to FIG. 2, the hopper and feed means 12 includes a pair of laterally spaced side frame members, one of which is shown at 50, on which are mounted a pair of laterally spaced upstanding rods 52 and two pairs of laterally spaced upstanding bars 54 and 56. The rods 52 and bars 54, 56 define the hopper 16 and are adapted to receive and maintain a stack of primary envelopes in a predetermined relation to the feeder with the major longitudinal axes of the rectangular envelopes substantially parallel to the direction in which the envelopes are fed to the conveyor means 22. A support plate 58 is mounted to lie beneath and between the pairs of guide bars 54 and 56 so as to support the envelopes within the hopper and prevent sagging thereof. A pair of envelope guides, one of which is indicated at 60, assist in maintaining the lower envelopes in the stack in proper position preparatory to feeding.

The feed means 12 includes a driven pair of laterally spaced feed belts 64 one of which is illustrated at 64*a*, which are supported at their upper ends on idler rollers 66 mounted on a transverse support shaft 68, and are supported at their lower ends on a transverse drive shaft 70 which is rotatably driven in predetermined timed relation with movement of the conveyor means 22, such as through a timing chain drive similar to that of the aforementioned Halm Model JP-6. A pair of laterally spaced presser belts 74*a* and 74*b* (FIGS. 2 and 3) are supported on respective sets of idler rollers 76*a*–*d* carried by transverse support shafts 78*a–d*, respectively, which have their opposite ends suitably journaled to the laterally spaced side frame members 50 of the feeder means 12. The belts 74*a* and 74*b* are cooperative with the feed belts 64 to effect positive feed of successive envelopes from the hopper 16 to the conveyor means 22.

To effect selective feeding of primary envelopes from the hopper 16 to the nip defined by the engaging upper reaches of the feed belts 64 and presser belts 74*a* and 74*b*, a generally cylindrical suction block 80, is mounted on a transverse support shaft 82 for rotation about its longitudinal axis. The suction block 80 has a connector rod 84 eccentrically connected thereto to enable selective rotation of the block between a forward and a rear position. The connector rod 84 is engagably connected at its lower end to a continually rotating cam drive 86 and has operative association with a feeder control solenoid 88 to enable selective feeding of envelopes from the hopper 16 through the feeder means 12. The cam drive 86 is interconnected to the conveyor chain drive so as to rotate in fixed relation to movement of the conveyor means 22 as is conventional with the Halm JP-6. The suction block 80 has suction ports intersecting its peripheral surface which are connected to a source of vacuum (not shown) having a control solenoid operative therewith to facilitate selective feeding of primary envelopes 14 from the feeder means 12 and the establishment of selective spaces therebetween as will become more apparent hereinbelow in the description of the control logic. The vacuum supply and associated solenoid operated suction control valve are of known design.

Operationally, solenoid 88 is enabled to engage connector rod 84 with the cam drive 86. Engagement with the cam drive 86 causes the connector rod 84 to reciprocate thereby moving the suction block 80 from the forward to the rearward position in a cyclic fashion. At the forward position when suction is applied to its ports, the suction block 80 will pull an envelope from the space between support plate 58 and envelope guides 60. As it rotates in time with cam drive 86 to its rearward position, the suction block 80 will carry the envelope to the nip between the feed belts 64 and presser belts 74. At which time the suction to the block 80 is released and the envelope is carried by the frictional action of the belts 64 and 74 to be deposited on the conveyor 22. A shaft encoder 87 is used to determine a reference position in the cycle for timing the vacuum switching. It is evident that the feed mechanism 12 supplies a continuous stream of envelopes or selected spaces when solenoid 88 is engaged. Whether a space or an envelope is fed into the continuous stream is governed by whether vacuum is applied to the suction block 80.

Figure 3:
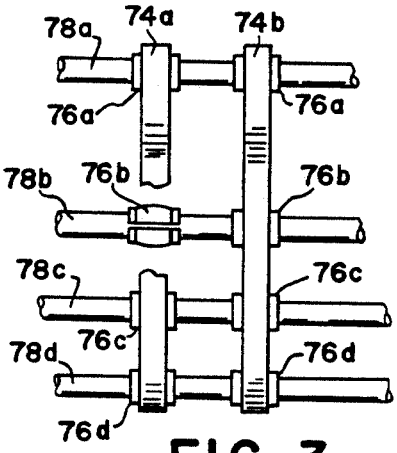
FIG. 3 is a fragmentary sectional view of the primary envelope feeder taken substantially along lines 3—3 of FIG. 2.

With particular reference to FIG. 3, the pairs of presser belt support rollers 76*a–d* may be formed as semi-annular segments which are fixed on the respective support shafts 78*a–d*. The idler rollers are preferably slightly convexly crowned and have annular flanges at their opposite ends to maintain the associated presser belts 74*a* and 74*b* in generally fixed feeding relation with the feed belts 64. The presser belts 74*a* and 74*b* prevent the envelopes from wrinkling or buckling along their major longitudinal lengths as they are fed from the hopper 16 to the conveyor means 22. It will be appreciated that the feed belts 64 and associated presser belts 74 are spaced laterally apart a distance sufficient to effect desired engagement with the marginal edges of the envelopes to effect a desired positive feed control to the conveyor means 22.

A photoelectric sensor 92 is mounted on one of the upstanding guide bars 54 or 56 and is operative to photoelectrically detect the presence of envelopes within the hopper 16. The photoelectric sensor 92 may comprise a light emitting diode (LED) and a suitable phototransistor such as available from Skan-A-Matic Corp., Elbridge, N.Y., as its model L33/P33 series. Another photoelectric sensor 96 is mounted on a suitable transverse support bar 98 fixed on the feeder means 12 so as to detect the feeding of envelopes by the suction block 80. The photoelectric sensor 96 may comprise a photoelectric scanner of known design, such as available from Skan-A-Matic as its model S13255.

In the feeding of primary envelopes from the primary feed means 12, it is important that only one envelope at a time be fed to the conveyance means 22 from the primary envelope feeders. To detect the feeding of more than one envelope from the envelope supply hopper 16, the main feeder 12 has a pair of pinch rollers, one of which is indicated at 104 in FIG. 2. The rollers 104 are rotatably carried on associated support arms 106 which are pivotally mounted on the transverse support shaft 68 such that the pinch rollers engage the outer peripheral surface of the associated suction block 80 so as to be moved pivotally outwardly from the suction block as each envelope is fed to the feed belt 64. A switch actuator plate 108 is mounted on one of the support arms 106 and is operative, if two envelope thicknesses are detected, to actuate a microswitch 110 which forms a double feed sensor. The switch 110 is connected in the circuit for the overall control for the envelope processing system 10 in a manner to be described in greater detail hereinbelow.

Figure 11:
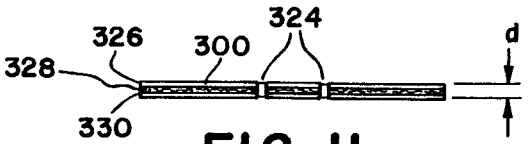
FIG. 11 is a cross-sectional view of the vacuum belt taken along lines 11—11 in FIG. 10.

As aforementioned, the primary envelopes 14 are fed from the hopper and feed means 12 and thereafter are printed by printing means 18 with indicia which, in the case of church offertory envelopes, may identify the particular church organization. The printing means 18 is a cylinder type press having an upper plate carrying cylinder and a lower impression cylinder between which the primary envelopes are passed from the feed means 12. In the illustrated embodiment, the upper plate cylinder is a "two-up" print cylinder, although a "one-up" print cylinder may also be employed. The lower impression cylinder is movable to press an envelope against the upper rotating plate cylinder under the control of an actuating solenoid (not shown) which is controlled by the control logic of the envelope processing system 10 to be described. An envelope sensor in the form of a scanner type LED, indicated schematically at 114 in FIG. 11, is positioned between the printer means 18 and the feed belts 64 and is operative with the control logic to drop the impression cylinder away from the plate cylinder of the printer means 18 when a previously established space between the primary envelopes 14 reaches the printer means 18, thus preventing direct engagement of the impression cylinder with the upper plate cylinder.

The eight inserters 28*a*, 28*b*, 28*c*. . . , 28*f*, 28*g*, 28*h* comprise individual in-line inserting units wherein each unit is generally similar to the aforedescribed hopper and feed means 12 for the primary envelopes. Additionally, each has been modified to provide positive feed presser belts 74 as described in connection with the feeder means 12. The hoppers 32 on the inserters 26 are substantially identical to the hopper 16 for the primary envelopes and each has envelope level photoelectric sensor means thereon similar to the aforedescribed primary envelope level sensor 92. Each of the inserters 26 also has a photoelectric feed sensor 96 and a double feed sensor 110 which are connected in the control circuit for the processing system 10 in a manner to be described.

The inserters 26 differ from the primary envelope hopper and feed means 12 only in that each has upper and lower suction blocks which are connected to the vacuum source and have two solenoid actuated control valves operative to facilitate selective feeding of insert envelopes onto the conveyance means 23. For the inserters 26, the solenoids operative to effect movement of the upper suction blocks, termed the feed solenoids, receive signals separate from the signals applied to the solenoids controlling the movement of the corresponding lower suction blocks. Both the upper and lower suction blocks are driven from a cam drive 86 in a timed cyclic motion.

The inserters 26 are driven with timing chains which mechanically time the cycles of the feeder 12 and inserters 26 together. In other words, the suction blocks and feed belts are driven such that if vacuum is applied to the suction blocks at the correct time, any selected space can be filled in the continuous stream with an insert envelope.

To establish pulse control signals in direct response to movement of the inserters 26, and thus establish process interrupts for the data processor 240, a series of shaft encoders, indicated schematically at 126*a*, 126*b*, 126*c*, . . . , 126*f*, 126*g*, 126*h*, in FIG. 1, are mounted on the support frame for the inserter stations 26 and associated portion of the conveyance means 23. Each shaft encoder 126 may, for example, comprise a rotary transducer that generates a pulse output proportional to shaft rotation such as commercially available from Kynapar Corporation under its trade name Rotopulser. Each encoder 126 identifies a reference position in the mechanical cycle of an associated inserter 26 indicating the device is ready to insert an envelope.

Figure 6:
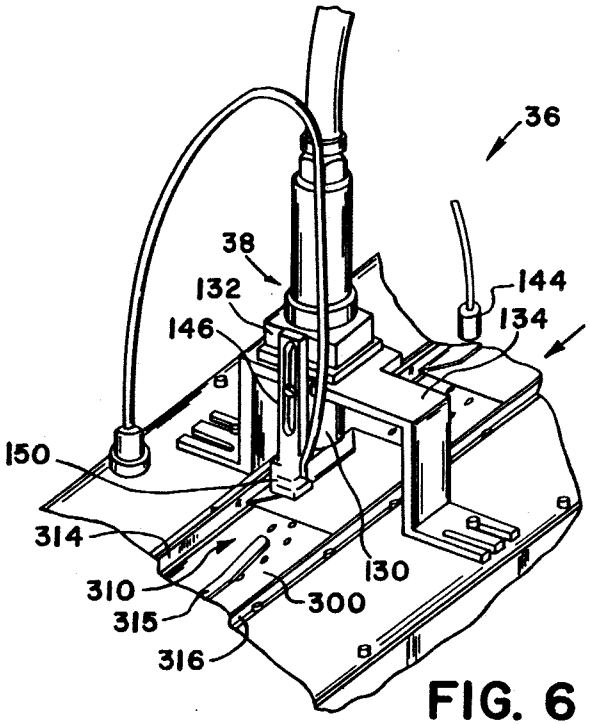
FIG. 6 is a fragmentary perspective view illustrating the high speed printing station of the processing system illustrated in FIG. 1.

As aforedescribed, when the primary and insert envelopes are conveyed by the conveyance means 23 to the second printing means 38, each successive envelope is printed with individualized indicia such as a date and an identification or serial number which is to be common to each envelope of a set or batch of envelopes. Referring to FIG. 6, the second printing means 38 comprises a high speed ink jet type printer such as commercially available from A.B. Dick Company as its Model 9130 ink jet printer.

In the illustrated embodiment, the high speed printing means 38 includes a generally cylindrical printhead 130 which is suitably supported in upstanding relation on a support plate 132 which, in turn, is supported on a support plate 134 mounted transversely of the conveyance means 23 in spaced relation thereabove. The support plate 132 is transversely adjustable along the support plate 134 to enable selective positioning of the printhead 130 relative to the transverse (width) dimension of envelopes passing therebeneath. The support plate 134 has a suitable opening generally centrally therein to accommodate adjustment of the printhead 130. The positioning of the printhead 130 provides a serial in-line printing of indicia along the longitudinal axis on an envelope. It is evident that one or more lines can be printed by increasing the number of printheads. The printhead 130 is interconnected to the ink jet control console, indicated schematically at 138 in FIG. 1, through a flexible ink supply and control cable 140.

Operation of the printhead 130 is effected by the data control processor 240 (FIG. 1) in response to a process interrupt generated by a photoelectric sensor 144 mounted upstream from the printhead so as to detect the presence of an envelope approaching the printhead from the inserter stations 26. In the illustrated embodiment, the photoelectric sensor 144 comprises an LED reflective scanner similar to the aforedescribed scanner sensor 94. The sensor 144 is supported by a suitable support bracket 146 mounted on the support plate 134 so that the sensor overlies the conveyance means 23 generally centrally between envelope guide angles 314 and 316 which extend from the inserter stations 26 to and beneath the support plate 134 for the printhead 130.

A print sensor 150 is mounted on the support plate 134 downstream from the printhead 130 so as to directly overlie the in-line printing applied by the printhead 130 in the longitudinal direction of each of the envelopes passed beneath the printhead. The print sensor 150 may comprise a color detection fiber optic scanner as commercially available from Skan-A-Matic as its S35 series. The print sensor 150 is capable of sensing the density of print applied by the printhead 130 and is connected in circuit with the system control circuit so as to "read" or sense print at specific locations along the length of each of the envelopes corresponding to predetermined positions in which print is to be applied by the printhead. From the second printer means 38, the primary and insert envelopes upon which indicia has been printed by the printhead 130 are passed to the transfer station 42 by the conveyance means 23.

Envelopes passing under the printing station 36 are held flat by a vacuum on the surface of a vacuum belt 300 against the belt as they are moved along a channel 308 between the guide angles 314 and 316 of conveyance means 23. This provides a flat surface on which to print indicia by the ink jet head 130. A steel finger 315 is used to ensure that the leading edge of each envelope is sealed to the belt 300 prior to entering the transfer station 42 and packaging station 46.

Figure 5:
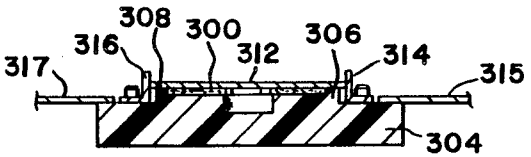
FIG. 5 is a partial cross-sectional view of an envelope and the vacuum belt, guide rails, and vacuum plate of the conveyance means taken along lines 5—5 in FIG. 4.
Figure 4:
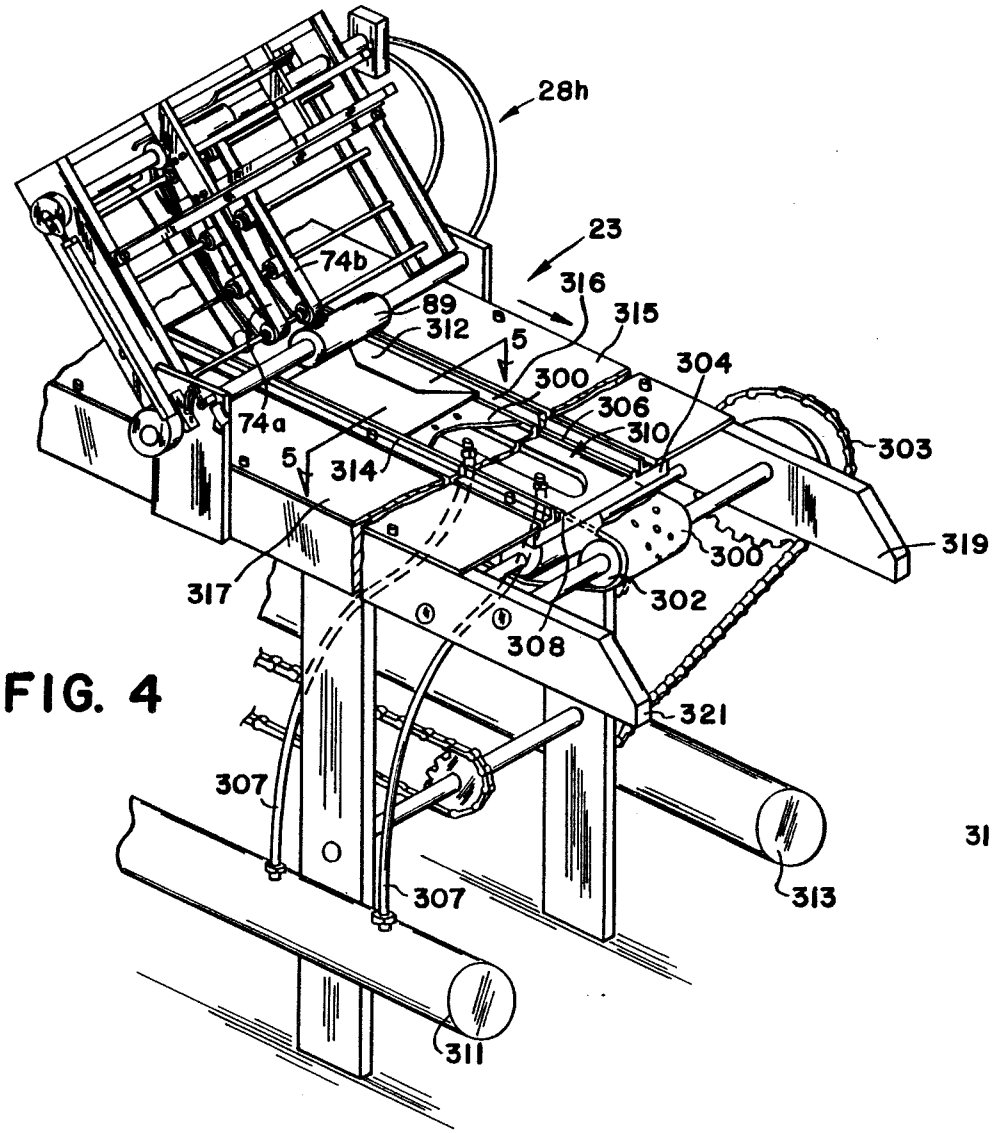
FIG. 4 is a fragmentary perspective view of the conveyance means of the processing system illustrated in FIG. 1.
Figure 7:
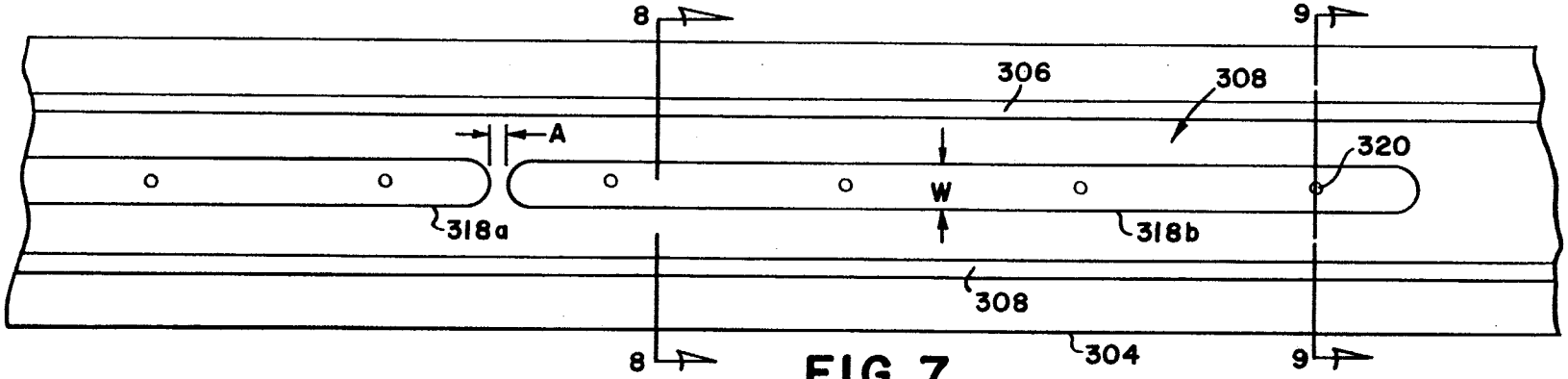
FIG. 7 is a top fragmentary view of the vacuum plate of the conveyance means illustrated in FIG. 4.
Figure 9:
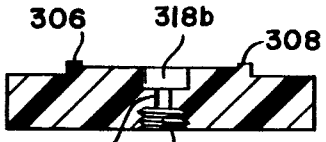
FIG. 9 is a cross-sectional view of the vacuum plate taken along lines 9—9 in FIG. 7.
Figure 10:
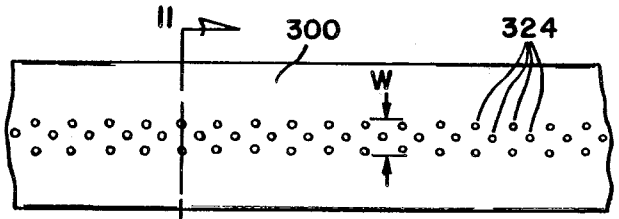
FIG. 10 is a top fragmentary view of the vacuum belt of the conveyance means illustrated in FIG. 4.
Figure 8:
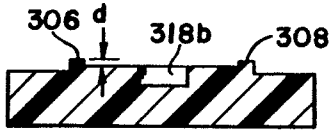
FIG. 8 is a cross-sectional view of the vacuum plate taken along lines 8—8 in FIG. 7.

The conveyance means 23 are more fully illustrated in FIGS. 4 and 5. FIG. 4 illustrates a fragmentary view of the distal end of conveyance means 23 with the transfer station 42 omitted. The conveyance means 23 include, instead of the pusher chain of the previous system, a flexible endless vacuum web or belt 300 which is positively driven at each end by a set of drive pulleys, one shown at 302, from timing chains at 303. The web 300 is guided and slides in a channel 310 of a vacuum bar plate 304. The envelopes from the primary station 12 and those from the inserter stations 26 are transferred to the belt 300 at predetermined times and positions. A vacuum on the belt holds the envelopes at that particular position or time in the continuous stream such that they may be transferred at high speed through the inserter stations 26 and second printing station 36 to the transfer and packaging stations 42 and 46.

The conveyance means 23 extends from its head end at the first printing station 18 to its distal end at the transfer station 42. The vacuum belt or web 300 is supplied through conduits 307 from vacuum plenums 311 and 313 located at the bottom of the envelope processing system 10. In the breakaway of FIG. 4, it is seen that at each end the belt 300 forms a loop which travels around two the driven main pulleys 302, and two idler pulleys, one at 303. The main driven pulleys 302 are somewhat lower than the bed or channel 310 of a bar plate 304 so that a flat sliding contact is maintained in the channel of the bar plate by the belt 300. The drive pulleys 302 are ganged with timing chains and gears to move the belt 300 in timed relation to the primary feeder 12 and inserters 26. The timing maintains the positioning of the envelopes and spaces of the continuous stream relative to the initial feed sequence.

The vacuum bar plate 304 on which the vacuum belt 300 slides is shown in cross section in FIG. 5. The bar plate 304 is generally rectangular in cross section and includes two upwardly raised rail members 306 and 308 spaced apart substantially the width of the vacuum belt 300. The inner extent between the two rails 306 and 308 defines a belt channel 310 and limits the travel of the vacuum belt laterally. The rails 306 and 308 rise above the vacuum belt channel 310 approximately the same height as the belt 300 such that an envelope 312 will slide along the rails and on the belt. The rails 306 and 308 are thin so they do not induce any substantial drag on the envelopes. Laterally located on the shoulders outside the rails 306 and 308 are the upwardly standing L-shaped guide angles 314 and 316 which are spaced apart substantially the width of the envelope 312. The outside shoulders of the bar plate 304 are fixed to shelves 315 and 317, which are cantilevered from frame members 319 and 321, respectively of apparatus 10. In operation, an envelope 312 is held to the belt 300 at a certain position by a vacuum, slides on the rails 306 and 308 of the bar plate 304, and is confined to the channel between the guide angles 314 and 316 during its conveyance through conveyance means 23.

The final inserter station **28*h* is illustrated to describe the transfer of an envelope 312 from an inserter to the belt 300. Similar to the feed if described for the primary feeder 12, an envelope is provided to the nip of the drive belts 64 and presser belts 74. The envelope 312 is then pulled by positive action of the lower suction block 89 part way onto the web 300. As the suction on the web 300 begins to hold that portion of the envelope 312, the solenoid controlling suction to the suction block 89 is disabled thereby allowing the envelope to be fully engaged by the holding force on the web as it moves. It will be appreciated that such positive transfer produces a rapid transfer and flattening of the envelope while also providing registration of the envelope between guide angles 306 and 308**.

The bar plate 304 and vacuum belt 300 are more fully illustrated in detail in FIGS. 7–11. The vacuum bar plate 304 is generally rectangular in cross section and extends the length of the conveyance means 23. The plate 304 can be machined from ultra-high-molecular-weight polyethelene which is light and easy to drill and cut. The vacuum for the holding the envelopes to the belt 300 is provided by a plurality of elongated slots **318*a*, 318*b*, etc. which are spaced substantially evenly along the bar plate 304. Each of these slots 318 serves as a small vacuum plenum to the belt vacuum apertures 324 moving above it. The apertures 324 in the belt 300 permit the vacuum in the slots 318 to be communicated to the surface of the belt where it causes the envelopes to stick to the belt surface. The slots 318 are spaced longitudinally a distance A on the bar 304 such that an envelope is always held by the vacuum of at least one of the slots while making a transition between two slots. The vacuum for each slot is provided by a series of apertures, one for example at 320, in the bar plate 304 which are connected by fittings to connector threads 322 of the vacuum conduits 307 fed by the reservoir plenums 311 and 313 on each side of the machine. A vacuum is drawn in the reservoir plenums and provides vacuum for each conduit 307 so that all slots 318** are equally under the same amount of suction.

In FIG. 11, the belt 300 is an endless loop made up of three layers with a polyvinyl chloride (PVC) layer 326 on top, a flexible fabric layer 328 in the middle, and a PVC layer 330 on the bottom. The layers 326, 328, and 330 are bonded together to form an integral structure which is wear resistant and durable enough to withstand high speed movement in the channel of the bar plate 304. The PVC bottom layer 330 assists the belt 300 in sliding the belt in channel 310 of the bar plate 304 by reducing friction and further by maintaining a vacuum seal. The materials of the belt 300 (PVC) and plate 304 (polyethelene) combine to produce a tight, vacuum retaining substantially friction free sliding fit without lubrication.

It is important to provide a substantially frictionless fit without wet or dry lubrication material because of the high speed of the conveyance means 23 and the articles conveyed, i.e., envelopes. If the belt 300 had to be lubricated, such material would likely stain the envelopes and make the product unmarketable. If no lubrication were used and the belt 300 generated considerable friction, it is likely that extreme wear or stretching because of heat buildup would result. Further, lubrication of the belt 300 is difficult because the vacuum would tend to cause uneven lubrication and the necessity of constant replenishment.

The vacuum feed apertures 324 of the belt 300 are centered in the middle of the laminate along its length approximately a width W. The apertures 324 communicate with the vacuum in the slots 318 to provide suction for envelopes laying on top of the belt and are generally limited to the width W of the slots 318. The apertures 324 are generally limited to the width of the slots 318 so that limited vacuum escapes around the edges of the belt and further does not provide a restraining force for movement of the belt 300 in the channel 310.

Figure 12:
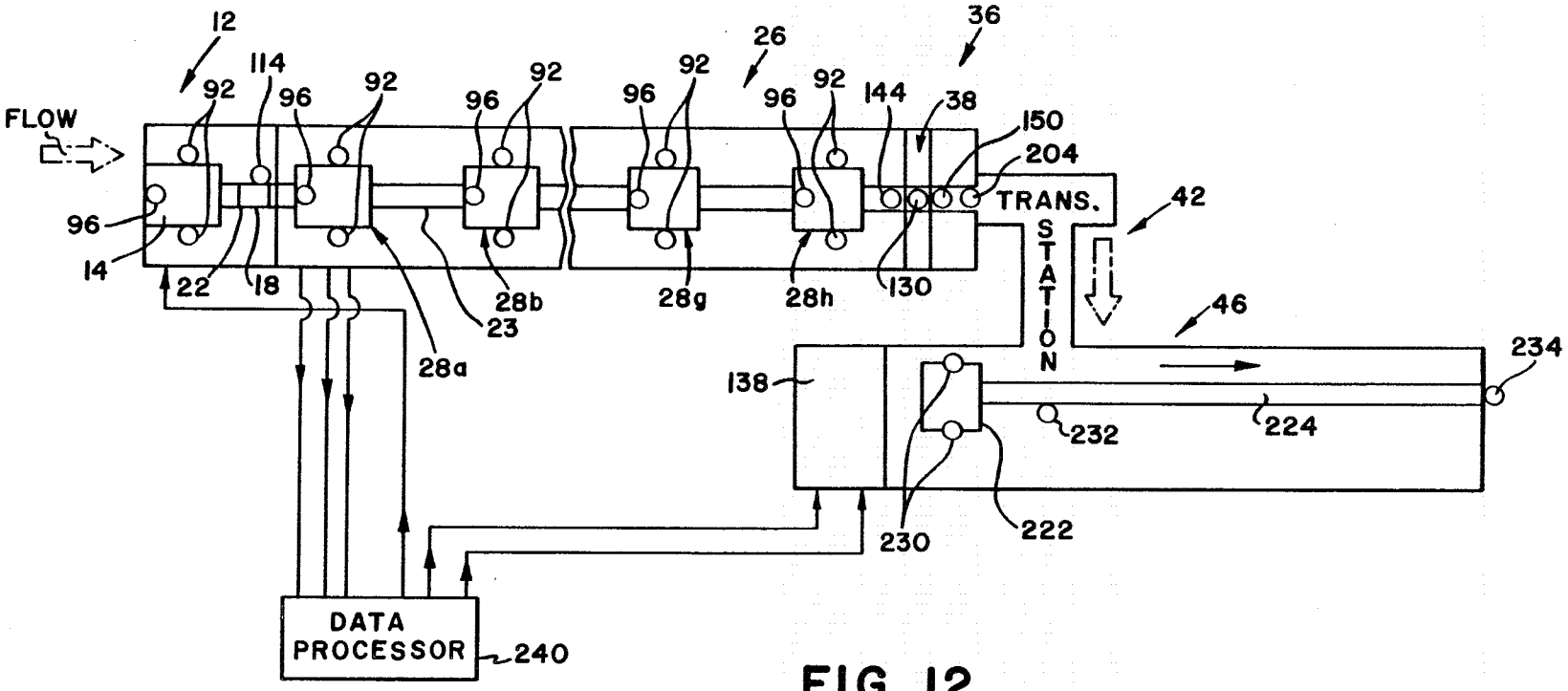
FIG. 12 is a schematic diagram of the envelope processing system of FIG. 1 showing the location of the various electronic sensors.

The various photoelectric sensors employed in the illustrated embodiment of the envelope processing system 10 are illustrated schematically in FIG. 12 in relation to the primary hopper and feed means 12, inserter stations 26, high speed printing means 38, transfer station 42, and packaging station 46. Various photoelectric sensors 92, 96, 114, 144, 150, 204, 230, 232 and 234 are shown in schematic relation to the data processor 240 indicated schematically. In the illustrated embodiment, the data processor 240 comprises an IBM Series I minicomputer having a cathode ray display monitor 242 on which alphanumeric data is visually observable. The various photoelectric sensors provide signals to the data processor 240 in the form of interrupt signals indicating a predetermined position of the primary and insert feeders, a lack of envelopes within the hoppers 16, 32, absence of an envelope being fed by the feeders of the primary hopper and feed means 12 and inserter stations 26, absence of an envelope in position to be printed by the printing means 38, the absence of proper printing (sufficient density) on the envelopes by the printing means 38, the passage of successive envelopes into the transfer station 42, a lack of cartons in hopper 222, failure of a properly formed carton to appear at the carton loading 212, and the presence of a filled carton.

The operation of the envelope processing system 10 and the interrelationship of the various components will now be described from the task control logic diagram illustrated in FIG. 13A. The logic control is broken into a plurality of separate logic tasks each of which resides in and is controlled by a control program of the data processor 240.

A first task indicated schematically at 250 controls feeding of envelopes from the primary envelope hopper and feed means 12 and their printing. Release or feeding of envelopes from the primary hopper 16 and the establishment of spaces between selected ones of the primary envelopes is based on impulses (interrupts) received by the data processor 240 from the shaft encoder 87. Each pulse from a shaft encoder 87 causes tne main program within the data processor to be advanced or transferred to a correct subroutine for handling the device. Printing is based on interrupts from envelope sensor 114 and engagement of the impression solenoid.

Thereafter, a number of tasks indicated schematically as 251 control the feeding of envelopes for each of the insert envelope feeders or inserter stations 26. The feeding of the envelopes from inserter stations 26 is based on the interrupts from the shaft encoders 126. Each pulse from a respective encoder calls a corresponding routine which switches the vacuum to the upper and lower suction blocks, to handle the device.

Another task logic is indicated at 252 in FIG. 13 and serves to control the second printing means 38 and establish the indicia printed in-line on each successive envelope by the printhead 130. The second task logic 252, which may be termed the ink jet printer handler logic, is based on an interrupt signal received from the product sensor 144. Each pulse interrupt from the sensor 144 causes the data processor 240 to advance to the next entry in a predetermined print program in memory within the data processor.

Another task logic is indicated at 254 in FIG. 13 and is termed the transfer station and packaging station logic. The transfer and packaging station task logic 254 is responsive to the transfer sensor 204 which provides an interrupt pulse with each passage of an envelope into the transfer station 42. The transfer and packaging logic 254 is operative to actuate a solid state relay in a timing circuit (not shown) which is operative to energize the transfer station solenoid 186 and effect predetermined timed sequencing of the pusher cylinder 214, the presser cylinder 216 and the vacuum drawdown for the carton blanks within the hopper 222. Such timing control circuit may be of conventional design operative to provide the desired time sequencing of the transfer mechanism and packaging station functions.

System shutdown logic is indicated at 258 in FIG. 13A and is operative to effect actual shutdown of the envelope processing system 10 in the event any of the photoelectric sensors detect absence of envelopes or cartons within their respective hoppers, the envelope feed sensors 96 on the main feeder 12 and inserter stations 26 fail to detect an envelope being properly fed onto a conveyance means in the event of a double feed, or one of the envelope, printing or carton sensors 144, 150 and 232, respectively, failing to sense a proper corresponding function. Such error detection is indicated as "jam detect" in the task control logic and is fed to the system shutdown logic 258 which interfaces with error shutdown logic indicated at 260 within the data processor 240.

FIG. 13B illustrates the general format of the control program of the processor 240 for performing the logic tasks. The control program comprises a background task section 292 which is repeated after an initialization block 290, and a foreground task section 296 which is entered from the background section. The entry to the foreground section 296 is via interrupt through a priority handling routine 294. The execution of the program is by cycling through the background tasks 257, 258, and 260 until an interrupt occurs and then transferring control to the respective foreground task associated with the interrupt. When the foreground task is finished the program transfers control back to the location where it was interrupted in the background. If an interrupt occurs during a foreground task, the priority handling routine determines if the interrupt is of higher or lower priority than the interrupt presently being handled. If higher, the present foreground task is interrupted and control transferred to the higher priority foreground routine. If lower, the present foreground routine is finished and the interrupt is queued for subsequent execution before exiting to the background section 292.

Control of the envelope processing system by the task control logic is illustrated in the logic diagrams of FIGS. 14A–D. Each of the primary envelope and insert envelope feeders have a table that resides in memory within the data processor 240 and each of these tables has a series of entries which determine whether or not the corresponding primary envelope feeder 12 or inserter stations 26 is on or off in response to each pulse of the interrupts by shaft encoders 87 and 126. Each table has its own pointer which is either incremented or reset back to zero depending upon whether or not the last entry in a particular table has been reached.

Figures 14A, 14B:
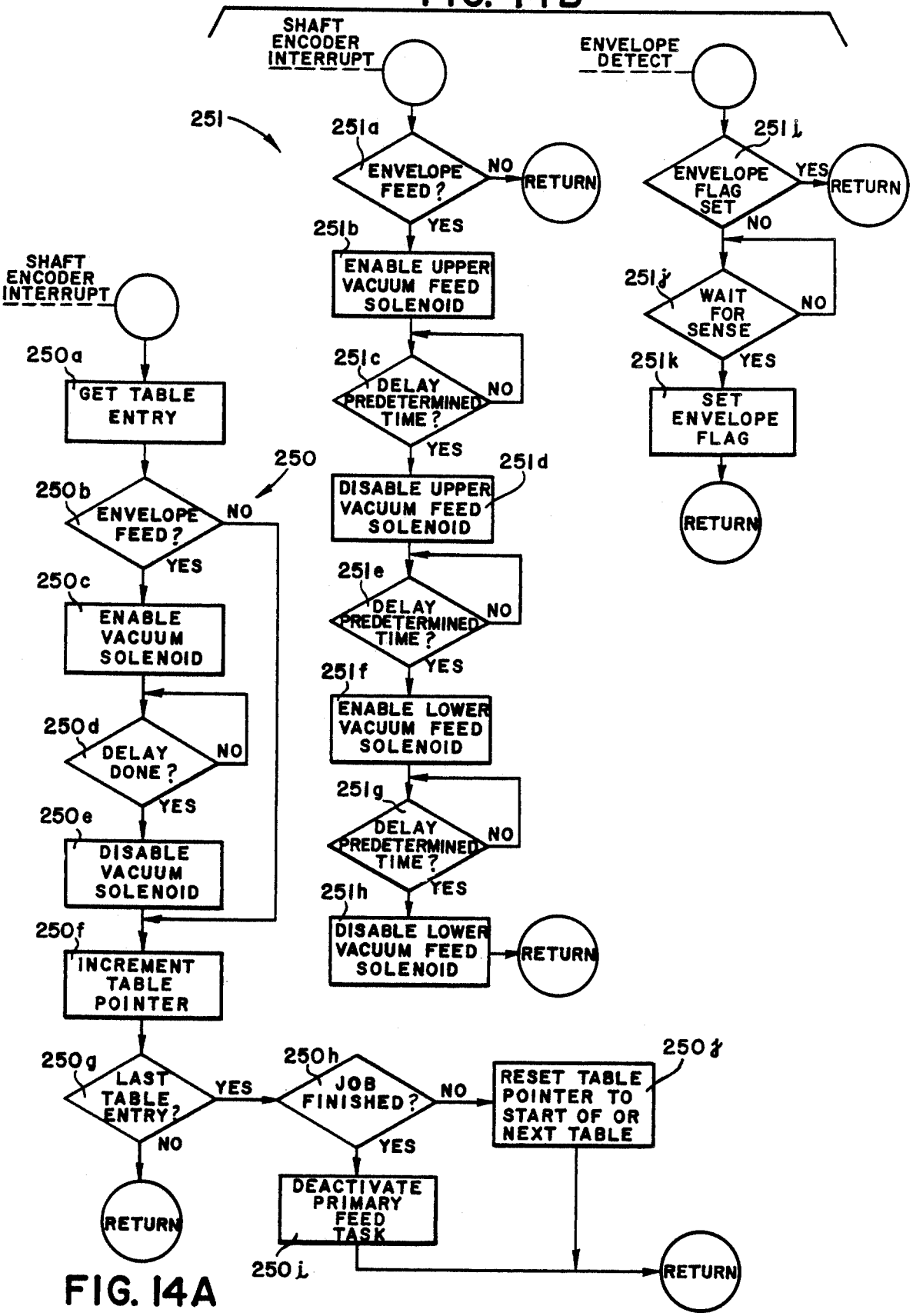
FIGS. 14A, 14B, 14C, and 14D illustrate in flow chart or block diagram form the control logic tasks for the data processor control employed with the envelope processing system of FIG. 1.

Referring to FIG. 14A, the logic for feeding of the primary envelopes by feeder 12 and printing of the envelopes by the printing means 18 is indicated by functional blocks indicated with reference numeral 250 followed by an alphabetical letter. The subroutine waits for an interrupt signal from the associated shaft encoder 87 which provides proper timing for feeding of an envelope from the hopper 16 onto the conveyance means 22. Block **250*a* receives an entry from the associated table for the primary envelope feeder 12. The entry indicates whether an envelope or a space is to be fed. Block 250*b* indicates that the control solenoid for the suction block 80** vacuum is either energized or disabled depending upon the table entry.

If an envelope is to be fed, the vacuum solenoid of the feeder 12 is enabled in block **250*c*, left in an enabled condition for a predetermined amount of time in block 250*d*, and then disabled in block 250*e*. If a space is to be fed or placed in the continuous stream, the program bypasses the vacuum solenoid control steps to block 250*f*. In block 250*f*** the table pointer is incremented to point to the next entry in the table.

Block **250*g* comprises a decision block which checks for the last table entry for the primary envelope feeder 12. If more envelopes are to be fed, the program returns to await the next interrupt. If the entry received by block 250*a* was the last entry in the table for the primary envelope feeder, block 250*h* checks to see if it is the last set of envelopes to be fed from the primary envelope hopper 16. If, in fact, it is the last set, then no other action is taken and the logic for the primary envelope inserter 12 deactivates the task in block 250*i* and returns. If it is not the last set of envelopes to be processed by the primary envelope feeder 12, the primary envelope table is reset back to the beginning, or to the next table, for recycling as indicated by block 250***j* before returning.

The control task 251 for each of the inserter stations 26 is shown in FIG. 14B and is essentially based on interrupts provided by the shaft encoders 126 and optical sensors 96. These interrupts call the software control subroutines which energize/deenergize the solenoids and solid state relays which in turn manipulate the mechanics of the inserters 26 and detect the envelopes at critical process points. The control of each of the inserter stations 26 is completely independent of the others. This is accomplished by using separate control tasks for each station in the software with timing interrupts being provided by the dedicated shaft encoders, one for each task. The detection software for the envelopes operates in a similar manner.

For each of the inserter stations 26 having a feed task, the operation in narrative form takes place as follows: (1) wait for the interrupt from the shaft encoder assigned to the inserter station, (2) determine if an envelope is to be fed for this cycle from the task table in block 251*a*, (3) if an envelope is to be fed, enable the upper and lower feed vacuum solenoids in blocks 251*b* and 251*f*, (4) leave the vacuum solenoid on for a predetermined amount of time in blocks 251*c* and 251*g* (5) disable the vacuum feed solenoids in blocks 251*d* and 251*h*, (6) return to waiting for the interrupt for this station, or (7) if no envelopes is to be fed, return to waiting for the interrupt for this station.

Detection of an envelope produces an interrupt which sets an internal flag to noting that the envelope has been seen. There is one product detect task for each inserter station which acts independently of all other tasks in the system. Such insert tasks occur as follows: (1) determine in block 251*i* if an internal flag indicating the envelope has been sensed is set, (2) wait in block 251*j* for the envelope to be sensed by the optical sensor, (3) set the internal flag indicating that the envelope has been seen in block 251*k*, or (4) return to the state where the internal flag indicates the envelope has not yet been sensed.

Figure 14C:
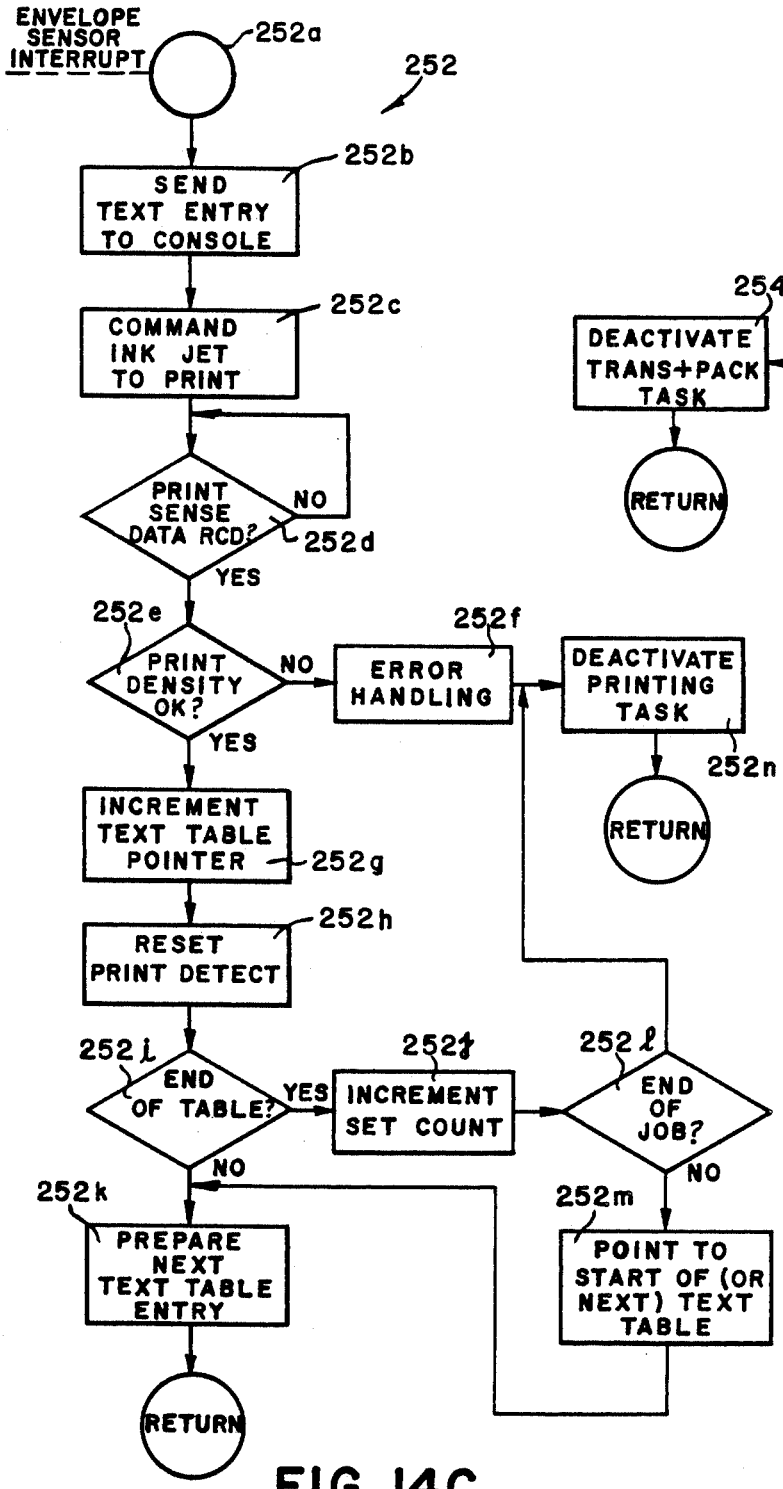

The logic corresponding to the printing task logic 252 for the ink jet printer of the second printing means 38 is indicated by blocks shown at reference numeral 252 with the associated alphabetical letters in FIG. 14C . The printing task logic 252 is entered by an interrupt of the envelope sensor 144 through block 252*a*. When a envelope is sensed by the sensor 144, a text entry which was previously prepared is sent to the control counsel 138 for the printhead 130 to affect printing as indicated by blocks 252*b* and 252*c*. Block 252*d* indicates a wait for the print sense entry from the detect sensor 150 and loops in the waiting mode until the data is received. If the print density is proper, as detected by block 252*e*, then the text table is incremented to the next entry by block 252*g*. The print detect sensor 150 is then reset in block 252*h* before determining if the end of the text table has been reached in block 252*i*. If the end of the table has not been reached, then the next text table entry is prepared prior to the interrupt in block 252*k* and the subroutine returns. This operation allows the text entries of the table to be incremented and prepared such that when the interrupt is sensed, the output can be rapidly printed without waiting.

If in block 252*i* the end of the table indicator was found, then in block 252*j* the set count is incremented. This is an indication of a full set of envelopes being printed in time to either begin a new set or end the job. Block 252*l* tests whether all sets have been printed and if not, the program will set the pointer to the start of the text table or to the start of a next table in block 252*m*. This operation allows either one particular set to be printed many times or different sets of the same type to be printed.

If in block 252*l* the end of job indicator is present or the print density is not OK as sensed by block 252*f* which accomplishes error handling, then the printing task is deactivated in block 252*n*. The program will then return with the printing task deactivated.

Figure 14D:
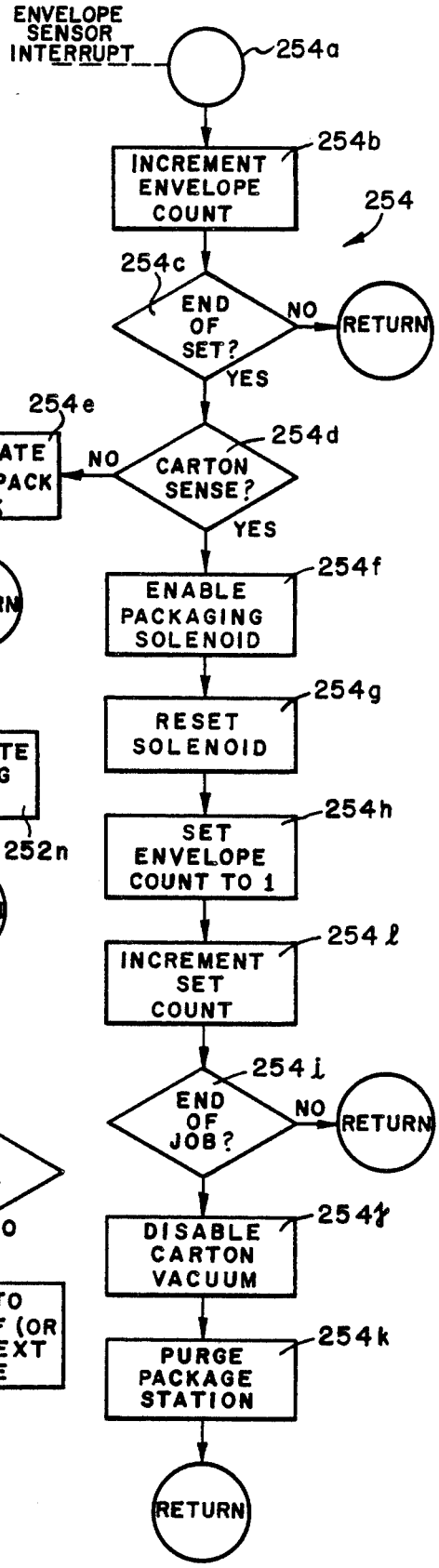

The logic for the transfer and packaging station, indicated schematically at 254 in FIG. 13, is indicated in the flow chart diagram logic of FIG. 14D by blocks identified with reference numerals 254 and alphabetical letters. Block 254*a* indicates a wait for an envelope interrupt by the envelope sensor 204 which is located between the printhead 130 and the transfer station 42. Block 254*b* represents count logic which is incremented by one with each interrupt provided by the detection of an envelope by the sensor 204. Block 254*c* is a decision block which checks for the end of the set. If the end of a set has not been reached, the negative branch returns the program to the first block 254*a* and waits for the next envelope to be sensed by the sensor 204. If the end of a given set has been reached, a check is made by a decision block 254*d* for presence of a properly erected carton in the envelope insert position as detected by the photoelectric sensor 232. If a carton is not properly positioned and detected by the sensor 232, logic block 254*e* causes the task to be deactivated.

If the carton sensor 232 detects a carton in the envelope loading station preparatory to inserting a set of envelopes therein, logic block 254*f* causes the turner members to dump or drop the set of envelopes therein to the underlying envelope receiving tray by enabling the packaging solenoid. The envelope receiving tray is controlled by a timing circuit operative to effect predetermined sequential operation of the carton loading cylinder and presser cylinder and insert the compressed envelopes into the properly positioned carton.

Logic block 254*g* indicates the reset of the packaging solenoid after approximately 10 milliseconds to prepare it for transfer of the next set of envelopes conveyed to the transfer mechanism 42. Once the packaging solenoid is reset, logic block 254*h* operates reset the envelope count to one and increment the set count. Next, a check is made by decision block 254*i* for the end of the job. If the end of the job is not indicated, the logic returns to await the next envelope interrupt. If the end of the job is indicated, the packaging station is purged after disabling of the vacuum to the drawdown mechanism for the next carton blank in the carton hopper as represented by logic blocks 254*j* and 254*k*. Purging of the packaging station comprises driving the conveyor forwardly to move the remaining filled cartons out of the packaging station preparatory to beginning the next job.

Thus, execution of each of the individual logic tasks 250, 251, 252 and 254 is based on corresponding process interrupts to the data processor 240. The process interrupts for the ink jet printhead 130 and associated control console 138 are generated by sensors 144 and 150. The process interrupts for the transfer and packaging stations 42 and 46, respectively, are generated by the photoelectric sensors 204, 230, 232 and 234. The process interrupts for the primary envelope feed means 12 and inserter stations 26 are generated by the shaft encoders 87 and 126 which are adapted to establish process interrupts or pulse signals upon each reaching a reference position in a mechanical feeder cycle. By process interrupt is meant that the photoelectric sensors make or break a photosensor contact and/or that the shaft encoder 126 presents a make or break 5 volt pulse to the data processor 240. The various logic tasks 250, 251, 252 and 254 run concurrently as if each were a separate entity.

In addition to the logic described, data used in setting up the various logic tables for the envelope feeders and inserters, the transfer and packaging stations, and the text table for the ink jet printer may be contained on a job diskette that is inserted into a data processor 240 at the beginning of each job. The diskette contains all of the information pertaining to the indicia which is to be printed on each successive envelope by the printhead 130, how many envelopes there are to be in each set, how many sets there are in each job, and how many total envelopes are to comprise a complete job. In addition, the diskette provides information for setting up the memory table for each of the primary and insert envelope hoppers and feeders.

Thus, a system for processing envelopes and the like is provided which effects substantially totally automatic operation in the making up or processing of sets of envelopes comprising primary envelopes on which common indicia is printed and between selected ones of which insert or special envelopes are inserted, followed by printing individualized indicia on each successive envelope in the set and thereafter automatically transferring and packaging each set of envelopes into a carton until a desired job lot has been completed. By providing for high speed in-line printing of individualized data, such as a date and a customer serial number or the like, on each successive envelope in a set, including both primary and insert envelopes, should the number of envelopes desired for a particular set be varied as by being reduced, no waste of insert envelopes results. The non-used insert envelopes may be returned to storage and used on a subsequent job having its own individualized indicia on each envelope. Moreover, by providing a fully automatic processing system, substantial labor expense savings will be realized with production costs of the final envelope sets being substantially reduced.

While a preferred embodiment of the present invention has been illustrated and described, it will be apparent to those skilled the art that changes and modifications may be made therein without departing from the spirit and scope of the invention which is defined in the appended claims.

What is claimed is:

1. A system for processing envelopes comprising:

conveyance means, adapted to receive and convey envelopes along a predetermined path, including a web moveable along said predetermined path having vacuum apertures therein, means for supplying vacuum to said apertures such that envelopes received by said web are held flat against the surface of said web at the location at which they are received during movement of said web at high speeds, and means for rapidly moving said web to convey said envelopes at high speeds;

first feed means, adapted to support a plurality of primary envelopes in a generally upstanding stack, for sequentially feeding said primary envelopes in a continuous stream onto said conveyance means and for interrupting said continuous stream to leave selected spaces in said stream in response to first predetermined command signals;

first printer means, cooperative with said conveyance means, for printing indicia on envelopes fed onto said conveyance means by said first feed means in response to first print command signals;

at least one inserter means, adapted to support a plurality of insert envelopes in a generally upstanding stack and cooperative with said conveyance means, for feeding said insert envelopes onto said conveyance means in said selected spaces in response to predetermined inserter command signals;

second printer means, cooperative with said conveyance means and operative in response to predetermined second print command signals, for printing individualized indicia on each successive primary and insert envelope passed along said predetermined path by said conveyance means; and control means operatively associated with said conveyance means, first feed means, inserter means and first and second printer means, said control means being adapted to provide said first predetermined command signals, said inserter command signals and said first and second print command signals in a predetermined sequence so as to automatically establish predetermined spacing between successive primary envelopes fed onto said conveyance means, cause successive primary envelopes to be printed by said first printer means, cause insert envelopes to be inserted into said selected spaces between said primary envelopes created for this purpose, and effect printing of individualized indicia on each successive envelope by said second printer means.

2. A system for processing envelopes as set forth in claim 1 wherein said control means further comprises:

primary sensor means associated with said first feed means for generating a primary envelope interrupt indicative of the ability of said first feed means to feed a primary envelope or a selected space into said predetermined sequence.

3. A system for processing envelopes as set forth in claim 2 wherein said control means further comprises:

means for storing a primary envelope table having a plurality of entries wherein each entry defines the absence or presence of a primary envelope or a selected space in said predetermined sequence.

4. A system for processing envelopes as set forth in claim 3 wherein said control means further comprises:

means, in response to said primary envelope interrupt, for generating said first command signals based upon the values of said entries in said primary envelope table.

5. A system for processing envelopes as set forth in claim 1 wherein said control means further comprises:

insert sensor means associated with said at least one inserter means for generating an insert envelope interrupt indicative of the ability of said at least one inserter means to feed an insert envelope into one of said selected spaces in said predetermined sequence.

6. A system for processing envelopes as set forth in claim 5 wherein said control means further comprises:

means for storing an insert envelope table having a plurality of entries wherein each entry defines the absence or presence of a respective insert envelope in one of said selected spaces in said predetermined sequence.

7. A system for processing envelopes as set forth in claim 6 wherein said control means further comprises:

means, in response to said insert envelope interrupt, for generating said inserter command signals based upon the values of said entries in said insert envelope table.

8. A system for processing envelopes as set forth in claim 1 wherein said control means further comprises:

first print sensor means associated with said first printing means for generating a first print interrupt indicative of the ability of said first printing means to print a primary envelope in said predetermined sequence.

9. A system for processing envelopes as set forth in claim 8 wherein said control means further comprises:

means, in response to said first print interrupt, for generating said first print command signals based upon the values of the entries in said primary envelope table.

10. A system for processing envelopes as set forth in claim 1 wherein said control system further comprises:

envelope sensor means associated with said second printer means for generating a second print interrupt indicative of the ability of said second printing means to print a primary or insert envelope in said predetermined sequence.

11. A system for processing envelopes as set forth in claim 10 wherein said control system further comprises:

means, in response to said second print interrupt, for generating said second print command signals based upon the values of the entries in said primary envelope table.

12. A system for processing envelopes as set forth in claim 1 wherein said control means further comprises:

primary sensor means associated with said first feed means for generating a primary envelope interrupt indicative of the ability of said first feed means to feed a primary envelope or a selected space into said predetermined sequence;

means for storing a primary envelope table having a plurality of entries wherein each entry defines the absence or presence of a primary envelope or a selected space in said predetermined sequence;

means, in response to said primary envelope interrupt, for generating said first command signals based upon the values of said entries in said primary envelope table;

insert sensor means associated with said at least one inserter means for generating an insert envelope interrupt indicative of the ability of said at least one inserter means to feed an insert envelope into one of said selected spaces in said predetermined sequence;

means for storing an insert envelope table having a plurality of entries wherein each entry defines the absence or presence of a respective insert envelope in one of said selected spaces in said predetermined sequence;

means, in response to said insert envelope interrupt, for generating said inserter command signals based upon the values of said entries in said insert envelope table;

first print sensor means associated with said first printing means for generating a first print interrupt indicative of the ability of said first printing means to print a primary envelope in said predetermined sequence; interrupt, for generating said first print command signals based upon the values of the entries in said primary envelope table;

envelope sensor means associated with said second printer means for generating a second print interrupt indicative of the ability of said second printing means to print a primary or insert envelope in said predetermined sequence; and means, in response to said second print interrupt, for generating said second print command signals based upon the values of the entries in said primary envelope table.

13. A system for processing envelopes as set forth in claim 1 wherein said first feed means further includes:

a reciprocating primary suction block for sequentially feeding primary envelopes from said upstanding stack or sequentially feeding selected spaces to said conveyance means depending upon whether suction is applied to said block, said suction block reciprocating at the frequency of said primary envelopes and said selected spaces in said continuous stream; and control valve means responsive to said first command signals for applying a vacuum to said suction block to feed a primary envelope and for blocking a vacuum from said suction block to feed a selected space.

14. A system for processing envelopes as set forth in claim 13 wherein said control means includes:

primary sensor means associated with said first feed means for generating a primary envelope interrupt indicative of a reference position in the reciprocation of said primary suction block;

means for storing a primary envelope table having a plurality of entries wherein each entry defines the absence or presence of a primary envelope or a selected space in said predetermined sequence; and means, in response to said primary envelope interrupt, for generating said first command signals to said control valve means based upon the values of said entries in said primary envelope table.

15. A system for processing envelopes. as set forth in claim 14 wherein said at least one inserter means further includes:

a reciprocating insert suction block for sequentially feeding insert envelopes from said upstanding stack to said conveyance means depending upon whether suction is applied to said block, said suction block reciprocating at the frequency of said primary envelopes and said selected spaces in said continuous stream; and control valve means responsive to said inserter command signals for applying a vacuum to said suction block to feed an input envelope and for blocking a vacuum from said suction block to feed a selected space.

16. A system for processing envelopes as set forth in claim 15 wherein said control means includes:

insert sensor means associated with said at least one inserter means for generating an insert envelope interrupt indicative of a reference position in the reciprocation of said insert suction block;

means for storing an insert envelope table having a plurality of entries wherein said entry defines the absence or presence of an insert envelope in one of said selected spaces in said predetermined sequence; and means, in response to said insert envelope interrupt, for generating said inserter command signals to said control valve means based upon the values of the entries in said insert envelope table.

17. A system for processing envelopes as defined in claim 1 wherein said means for supplying vacuum includes:

a bar plate having a pair of upstanding rails defining a channel having a bottom in which said web can be slidably moved between said rails; and means for supplying a vacuum to the bottom of said channel, said vacuum apertures communicating with the bottom of said channel.

18. A system for processing envelopes and as defined in claim 17 wherein:

said rails are substantially the same height as the thickness of said web so that envelopes received on said web will be held on said web and slide on said rails.

19. A system for processing envelopes as defined in claim 18 wherein said bar plate further includes:

a shoulder extending away from each rail which is lower than the corresponding height of the rail such that an envelope sliding on said rail can overhang said shoulder.

20. A system for processing envelopes as defined in claim 19 wherein said bar plate further includes:

upstanding guide means on each side of said channel spaced away from said rails which define the width of a conveyed envelope, said guide means extending above said web and rails to provide an envelope conveyance channel which permits high speed transfer of the envelopes on said web.

21. A system for processing envelopes and the ike as defined in claim 17 wherein means for supplying a vacuum to the bottom of said channel includes:

a plurality of recessed vacuum slots spaced along the bottom of the channel which are fed by a vacuum and which are separated by a distance less than the length of one of the envelopes to be transported.

22. A system for processing envelopes as defined in claim 21 wherein:

said slots are elongated along the path of travel of said envelopes and centered in the middle of said channel.

23. A system for processing envelopes as defined in claim 22 wherein:

the vacuum apertures in said web extend from the center of said web only to the extent of the width of said slots.

24. A system for processing envelopes as defined in claim 22 wherein:

each slot is fed with vacuum from a reservoir plenum through a plurality of feed openings in said bar

25. A system for processing envelopes as defined in claim 8 wherein:

said feed opening and said reservoir plenum are communicated through corresponding vacuum feed tubes.

26. A system for processing envelopes as defined in claim 17 wherein:

said bar plate is formed of ultra high molecular weight polyethylene.

27. A system for processing envelopes as defined in claim 26 wherein:

said web is formed of a laminated structure having a top layer of PVC, a center layer of flexible fabric, and a bottom layer of PVC such that the bottom layer slides in the polyethylene channel of said bar plate to form a substantially frictionless sliding fit which is substantially vacuum maintaining.

28. A system for processing envelopes as defined in claim 17 wherein:

said means for moving including a first drive pulley at one end of said bar plate and a second drive pulley at the other end of said bar plate; and said web forms an endless belt which is looped over said pulleys and has at least a portion sliding in said channel.

29. A system for processing envelopes as defined in claim 28 wherein:

at least one of said pulleys is connected to a drive means which causes rotation of said one pulley and motion of said web longitudinally in said channel.

30. A system for processing envelopes as defined in claim 29 wherein said means for moving further includes:

at least one idler pulley for maintaining tension on said web so that at least one of said first and second drive pulleys can frictionally drive said web.

* * * * *